US006576119B2

(12) United States Patent
Ishida et al.

(10) Patent No.: US 6,576,119 B2
(45) Date of Patent: Jun. 10, 2003

(54) METHOD OF PRODUCING MIDDLE DISTILLATE PRODUCTS BY TWO-STAGE HYDROCRACKING AND HYDROCRACKING APPARATUS

(75) Inventors: Katsuaki Ishida, Toda (JP); Manabu Kobayashi, Toda (JP); Hiroki Koyama, Higashi-Kurume (JP); Seiji Togawa, Salmiya (KW); Futoshi Sakaguchi, Toda (JP)

(73) Assignee: Japan Energy Corporation, Tokyo (JP)

( * ) Notice: Subject to any disclaimer, the term of this patent is extended or adjusted under 35 U.S.C. 154(b) by 2 days.

(21) Appl. No.: 09/794,144

(22) Filed: Feb. 28, 2001

(65) Prior Publication Data

US 2002/0008051 A1 Jan. 24, 2002

(30) Foreign Application Priority Data

Feb. 29, 2000 (JP) ..... 2000-052779

(51) Int. Cl.[7] ..... C10G 65/02; C10G 65/10
(52) U.S. Cl. ..... 208/59; 208/58; 208/78
(58) Field of Search ..... 108/59, 78, 58; 502/50

(56) References Cited

U.S. PATENT DOCUMENTS

| | | | | |
|---|---|---|---|---|
| 3,213,013 A | | 10/1965 | Arey, Jr. et al. | 208/111 |
| 3,816,296 A | | 6/1974 | Hass et al. | 208/111 |
| 4,851,109 A | * | 7/1989 | Chen et al. | 208/18 |
| 4,894,142 A | | 1/1990 | Steigleder | |
| 5,141,909 A | | 8/1992 | Bezman | 502/66 |
| 5,366,615 A | | 11/1994 | Bezman | 208/111 |
| 5,888,377 A | | 3/1999 | Bertram | |

FOREIGN PATENT DOCUMENTS

JP 3212494 9/1991

OTHER PUBLICATIONS

Julius Scherzer et al.; Library of Congress Cataloging–in–Publication Data; published by Marcel Dekker, Inc. (1996), pp. 174–182.
Carmela V. Hidalgo et al.; Journal of Catalysis, vol. 85, pp. 362–369 (1984).
Koku Gijutsu, No. 501; pp. 17–23 (1996).
Hiromichi Ikebe; Petorotech; vol. 17, pp. 1032–1037 (1994).

* cited by examiner

*Primary Examiner*—Thuan D. Dang
(74) *Attorney, Agent, or Firm*—Birch, Stewart, Kolasch & Birch, LLP

(57) ABSTRACT

The two-stage hydrocracking process of the present invention comprises bringing the first-stage feed oil containing a hydrocarbon component and having a boiling point of 316° C. or higher into contact with the first-stage catalyst in the presence of hydrogen to obtain a first-stage product; separating the first-stage product into heavy component and light component containing the middle distillate products; bringing the second-stage feed oil containing heavy component of the first-stage reaction product into contact with the second-stage catalyst in the presence of hydrogen to obtain the second-stage product; separating the second-stage product into heavy component and light component comprising middle distillate products and recycling part of the heavy component of the second-stage product to the second-stage feed oil. Hydrocracking activity of the first-stage catalyst is higher than hydrocracking activity of the second-stage catalyst.

13 Claims, 1 Drawing Sheet

METHOD OF PRODUCING MIDDLE DISTILLATE PRODUCTS BY TWO-STAGE HYDROCRACKING AND HYDROCRACKING APPARATUS

BACKGROUND OF THE INVENTION

1. Field of the Invention

The present invention relates to a method of producing middle distillate products, such as kerosene, gas oil, etc., from the heavy distillate of petroleum distillate by two-stage hydrocracking, an apparatus used in the same hydrocracking, and a method of regenerating catalyst with reduced activity that has been used in the two-stage hydrocracking.

2. Description of Related Art

Hydrocracking is used in order to obtain middle distillate products for which there is a great demand, such as kerosene, gas oil, etc., from heavy oils, such as tar oil, residue, etc., for which there is relatively little demand. Related conventional technology is discussed in the book "Hydrocracking Science and Technology," by Julius Scherzer and A. J. Gruia, published by Mercel Dekker, Inc. (1996). According to this book, various hydrocracking processes are known, and the two-stage hydrocracking process is known as one of these processes.

Catalysts formed by containing a hydrogenation active component, such as molybdenum, tungsten, platinum, etc., in a carrier made of a refractory oxide, such as alumina, silica, silica alumina, zeolite, etc., are often used in two-stage hydrocracking. It is known that of these, hydrocracking catalysts containing zeolite have high cracking activity and stability, but generally have a tendency toward a lower middle distillate products selectivity when compared to hydrocracking catalysts that do not contain zeolite. Moreover, it is known that while hydrocracking catalysts that use noble metals, such as palladium and platinum, etc., as the hydrogenation active component provide high cracking activity and high middle distillate products selectivity, they are readily deactivated as a result of poisoning by sulfur compounds and they are difficult to use as catalysts in reaction zones where catalyst poisons are also present in high concentrations. It is further known that organonitrogen compounds and ammonia are poisons of hydrocracking reactions.

The concentration of organonitrogen compounds, ammonia, organosulfur compounds, and hydrogen sulfide in a feed oil fed to the second stage of the two-stage hydrocracking process is very low. Although strong cracking reactivity is easily obtained under such reaction conditions, over-cracking readily occurs and it is difficult to obtain a high middle distillate products yield. A method of adjusting operating conditions is disclosed in U.S. Pat. No. 3,213,013 whereby a nitrogen-containing base, such as an amine or ammonia, is introduced to the feed oil of the hydrocracking process in order to inhibit over-cracking during the initial stage of the operation and the amount of the nitrogen-containing base introduced is adjusted in accordance with the extent of catalyst degradation in order to obtain gasoline with a constant high octane value. A method for improving middle distillate selectivity is disclosed in U.S. Pat. No. 3,816,296 wherein ammonia or an amine is introduced during operation of the hydrocracking process. U.S. Pat. No. 5,141,909 and U.S. Pat. No. 5,366,615 disclose improvement of selectivity of jet fuel distillate by addition of ammonia or ammonia precursor during hydrocracking with a catalyst containing noble metal and zeolite. A method is disclosed in U.S. Pat. No. 5,888,377 wherein system operation can be made stable by introducing ammonia to the second-stage process with a catalyst containing zeolite during start-up of the two-stage hydrocracking process.

Moreover, ammonia TPD (ammonia temperature programmed desorption) is widely known as an effective method of characterization of the acidity of zeolite. For instance, C. V. Hidalgo et al. described in the Journal of Catalysis, volume 85, pages 362 to 369 (1984) that distribution of the amount of Bronsted acid center and acid strength of Bronsted acid center can be determined by ammonia TPD. Japanese Patent Application Laid-Open No. Hei 3-212494 (U.S. Pat. No. 4,894,142) discloses hydrocracking catalysts suitable for selective production of middle distillate products. The catalysts use hydrogen-Y-type zeolite with a low acidity whose unit lattice constant is 24.20 to 24.40 Å and amount of ammonia TPD acid as determined by ammonia TPD is less than 2.00 mmol/g.

Catalysts with reduced activity that have been used in hydrocracking processes are mostly regenerated after being removed from the reaction vessel or while being left packed in the reaction vessel. The regenerated catalyst reused as hydrocracking catalysts. Hydrocracking operation often is interrupted for the regeneration process of the catalyst, but this regeneration process wastes time in the hydrocracking process and is therefore undesirable from an economical point of view.

The obtained middle distillate products must satisfy specific properties as petroleum products. For example, Kazuo Yuta discloses in *Koku Gijutsu,* No. 501, 17-23 (1996) that combustibility of jet fuel is good on the order of paraffin, naphthene, and aromatics and that combustion performance can be assessed based on the smoke point, which is related to the aromatic content. Hiromichi Ikebe discloses in *Petorotekku,* volume 17, pages 1032 to 1037 (1994) that the cetane number is an index of ignitability of gas oil for diesel engines and that the cetane number of paraffins is high and of naphthalenes is low. Moreover, the cetane index is known as an index closely related to the cetane number and is widely used as an index of the quality of gas oil. These facts show that jet fuel and gas oil for diesel engines comprising a high aromatic content are undesirable because fuel properties degrades. Accordingly, it is predictable that inferior fuel properties likely results in products from jet fuel and gas oil for diesel engines produced from feed oil with a high aromatic content.

SUMMARY OF THE INVENTION

An object of the present invention is to provide a two-stage hydrocracking method for producing middle distillate products, with which the conversion percentage is high and the cracking reaction of the entire two-stage hydrocracking process proceeds with long-term stability at high selectivity for middle distillate products, and a hydrocracking apparatus used for the method thereof. In particular, the present invention is directed to provide a method for producing high-quality intermediate distillates that meet environmental regulations and have excellent properties as petroleum products, such as fuel oil, etc., by conversion of lower quality starting materials. Futhermore, the present invention provides a catalyst regeneration method with little time wasted during hydrocracking process and high operation flexibility.

The inventors of the present invention performed research for methods of producing middle distillate products by two-stage hydrocracking including at least two steps, processes in each of which crude hydrocarbon oil is brought into contact with a hydrogenation catalyst in the presence of hydrogen to obtain hydrocracking oil. The inventors also performed research for a catalyst that is appropriate for the above-mentioned two-stage hydrocracking. Moreover, the inventors have achieved the present invention based on a conception regarding a novel method of adjusting the catalysts to be used in a first-stage and a second-stage and the reaction environment with emphasis on the fact that while catalyst poisons are present in high concentrations during the first-stage, catalyst poisons are present in very low concentrations during the second-stage.

In accordance with the first aspect of the present invention, there is provided a method of producing middle distillate products by two-stage hydrocracking comprising the steps of:

bringing a first-stage feed oil containing a hydrocarbon component with a boiling point of 316° C. or higher into contact with a first-stage catalyst in the presence of hydrogen to obtain a first-stage product;

separating the first-stage product into a heavy component and a light component containing the middle distillate products;

bringing a second-stage feed oil containing the heavy component of the first-stage product into contact with a second-stage catalyst in the presence of hydrogen to obtain a second-stage product; and separating the second-stage product into a heavy component and a light component containing the middle distillate products and bringing part of the heavy component separated from the second-stage product into contact with the second-stage catalyst again;

wherein a hydrocracking activity of the first-stage catalyst is greater than a hydrocracking activity of the second-stage catalyst.

The present invention is characterized in that cracking activity of the first-stage catalyst used in the reaction zone in which catalyst poisons are present in high concentrations is controlled to be higher than that of the second-stage catalyst used in the reaction zone in which catalyst poisons are present in very low concentrations. This characteristic has the effect of prolonging life of the catalyst that is used in the reaction zone where catalyst poisons are present in high concentrations and also has the effect of improving middle distillate products yield by inhibiting over-cracking in the reaction zone in which catalyst poisons are present in very low concentrations.

In order to obtain the necessary catalytic cracking activity in the present invention, it is preferred that the first-stage catalyst is formed with a hydrogenation active component supported on a carrier containing zeolite and the second-stage catalyst is formed with a hydrogenation active component supported on a carrier that contains less zeolite than the first-stage catalyst. Alternatively, the first-stage catalyst may be formed with hydrogenation active component supported on a carrier containing zeolite and the second-stage catalyst may be formed with hydrogenation active component supported on a carrier that contains zeolite with a lower amount of ammonia TPD acid than the zeolite which is contained in the carrier of the first-stage catalyst. Preferably the first-stage catalyst and second-stage catalyst are formed with non-noble metal hydrogenation active components supported on a carrier consisting of refractory oxide, including zeolite.

Preferably, the second-stage catalyst of the present invention has 0.01 wt % or more nitrogen content. This has the effect of bringing the reaction to a stable state during the initial stage operation under hydrocracking conditions and the effect of increasing cracking activity when operation has entered the stable state after the initial stage. In order to add nitrogen component to the second-stage catalyst, the second-stage catalyst is preferably brought into contact with a pre-treatment agent selected from ammonia, organonitrogen compound, or petroleum distillate products containing 10 ppm or more nitrogen content before being used under hydrocracking conditions. Additive selected from ammonia, organonitrogen compound, or petroleum distillate product comprising 10 ppm or more nitrogen content may also be further brought into contact with the catalyst under hydrocracking conditions when the second-stage catalyst is used under hydrocracking conditions.

According to the second aspect of the present invention, there is provided a method of producing middle distillate products by two-stage hydrocracking using a first-stage catalyst and a second-stage catalyst layers, each of which has a catalyst is formed by supporting non-noble metal hydrogenation active component on a carrier, comprising:

a first step of regenerating a catalyst in one of the first-stage and second-stage catalyst layers by heating and exposing to an oxygen atmosphere the catalyst and by bringing the catalyst in the one of the catalyst layers into contact with a sulfur compound; and a second step of bringing feed oil into contact with the catalyst in the other of the first-stage and second stage catalyst layers in the presence of hydrogen during the first step in order to obtain a product. Since one of the first-stage catalyst and the second-stage catalyst can be regenerated while hydrocracking is continued with the other catalyst and therefore, it is not necessary to stop or interrupt the entire hydrocracking apparatus during catalyst regeneration. Regeneration of the first-stage catalyst and regeneration of the second-stage catalyst can also be performed in succession.

According to the third aspect of the present invention, there is provided a two-stage hydrocracking apparatus for producing middle distillate products, comprising:

a first-stage catalyst layer having a first-stage catalyst, which hydrocracks a first-stage feed oil containing a hydrocarbon component in the presence of hydrogen to produce a first-stage product;

a first-stage separator which separates the first-stage product into a heavy component and a light component comprising the middle distillate products;

a second-stage catalyst layer having a second-stage catalyst with a lower activity than the first-stage catalyst, the second-stage catalyst hydrocracking second-stage feed oil containing a hydrocarbon component in the presence of hydrogen to produce a second-stage product;

a second-stage separator which separates the second-stage product into a heavy component and a light component containing the middle distillate products; and a conduit which is provided between the second-stage catalyst layer and the second-stage separator and recycles part of the heavy component separated from the second-stage product to the second-stage catalyst layer.

DESCRIPTION OF THE PREFERRED EMBODIMENTS

[First-Stage Feed Oil]

Figure 1:
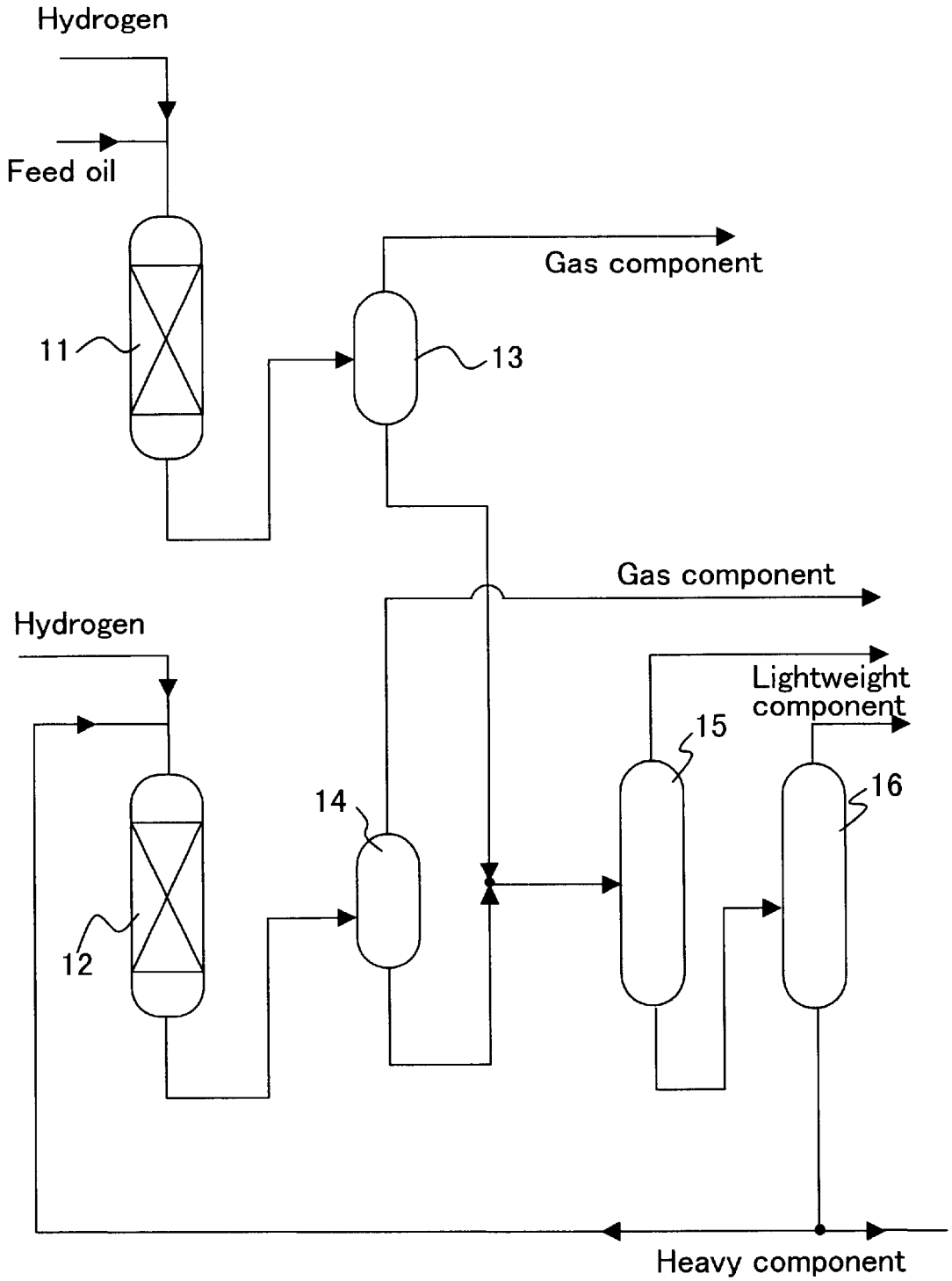
FIG. 1 is a diagram showing the two-stage hydrocracking apparatus used in the embodiment of the present invention.

There are no special restrictions to the first-stage feed oil used to produce middle distillate products by two-stage hydrocracking of the present invention as long as it contains a hydrocarbon content with a boiling point of 316° C. or higher, but it is preferred that it consists of essentially hydrocarbon content and that the 10% distillation temperature is 316° C. or higher, particularly 350° C. or higher. Moreover, it is preferred that its 95% distillation temperature is 600° C. or lower, further 580° C. or lower, particularly 545° C. or lower.

There are also no special restrictions to the metal content of the first-stage feed oil, but a smaller content is preferred. It is preferred that the vanadium content, nickel content, and iron content each be less than 2 ppm by weight, particularly less than 1 ppm by weight. There are no special restrictions to the sulfur content of the first-stage feed oil, but within a range of 0.1 to 4 wt % is preferred. There are no special restrictions to the nitrogen content of the first-stage feed oil, but within a range of 100 to 3,000 ppm by weight is preferred. There are no special restrictions to the aromatic content of the first-stage feed oil, but it is possible to produce high-quality middle distillate products by the present invention, even if the percentage of aromatic carbon atoms accounting for carbon atoms contained in the first-stage feed oil is relatively high, specifically 10 to 25%. The percentage of aromatic carbon atoms accounting for carbon atoms contained in the feed oil can, for instance, be quantitatively determined by nuclear magnetic resonance (IP392) or so-called n-d-M ring analysis (ASTM D 3238).

There are no special restrictions to the source of the first-stage feed oil, but it usually includes distillate obtained by vacuum distillation of atmospheric distillation residue of crude oil. It can also include distillate oil content obtained by vacuum distillation of the product of hydrorefining of atmospheric distillation residue. In addition, it can also contain substances derived from coal liquid, oil shell, oil sand, etc., and Fischer-Tropsch synthetic oil. The feed oil can further include pyrolysis oil. The pyrolysis oil used here means distillate obtained by pyrolysis of atmospheric distillation residue or vacuum distillation residue obtained from crude oil, coal liquid, oil shell, oil sand, etc., without using a catalyst. There are no special restrictions to the same method of pyrolysis, but conventional methods such as delayed coking, fluid coking, vis-breaking, etc., are preferably used.

[Middle Distillate Products]

The middle distillate products obtained by the present invention include jet fuel distillate, kerosene distillate, or gas oil distillate, or distillates containing these distillates, and have distillation properties, and etc., that correspond to the distillate that is to be obtained. The jet fuel distillate used in the present invention means a distillate having distillation properties that satisfy distillation property requirements at least 1 of the grades specified by JIS or ASTM, such as Jet A-1, etc. The term kerosene distillate used in the present invention means distillate having distillation properties that satisfy distillation property requirements of at least 1 of the grades of kerosene specified by JIS or ASTM. The term gas oil distillate used in the present invention means distillate having distillation properties that satisfy distillation property requirements at least 1 of the grades of gas oil specified by JIS and ASTM.

[Light Component and Heavy Component]

The light component used in the present invention means the middle distillate products that are the object of hydrocracking and also components that are lighter than the middle distillate products, while the heavy component used in the present invention means distillate that is heavier than the middle distillate products that are to be obtained.

[Two-Stage Hydrocracking Process]

The two-stage hydrocracking process of the present invention comprises (1) a step of bringing the first-stage feed oil containing a hydrocarbon component and having a boiling point of 316° C. or higher into contact with the first-stage catalyst in the presence of hydrogen to obtain a first-stage product; (2) a step of separating the first-stage product into heavy component and light component containing the middle distillate products that are to be obtained; (3) a step of bringing part of the heavy component of the second-stage product, which is described later, and the second-stage feed oil containing heavy component of the first-stage product into contact with the second-stage catalyst in the presence of hydrogen to obtain the second-stage product; and (4) a step of separating the second-stage product into heavy component and light component containing middle distillate products that are to be obtained.

A reaction zone where there is contact with the first-stage catalyst is simply referred to as the "first-stage" and a reaction zone where there is contact with the second-stage catalyst is simply referred to as "second-stage." There are no special restrictions to the first-stage and second-stage reaction systems, but a so-called fixed-bed flow-through system is preferred because the reaction procedure is easy. The first-stage and second-stage reaction vessels can each be a single vessel or multiple vessels. Hydrogenation catalyst is used by being packed into the first-stage and second-stage reaction vessels, or a catalyst and a packing with functions other than hydrocracking can be used by being packed into the reaction vessels. For example, they are a demetalization catalyst and a hydrorefining catalyst, and also they are a catalyst and a packing for elimination of micropowder contained in the feed oils, and a packing for supporting the catalyst, etc.

Above-mentioned steps (2) and (4) are separation processes of product. These steps are not limited to the specific processes and any other processes may be used as long as they satisfy the function of separation. In addition, above-mentioned steps (2) and (4) are processes with similar functions and therefore, systems for the respective processes can be constructed as separate system or as partially common to each other or fully integrated into a unit system. It is preferred that they be partially common to each other or fully integrated into the unit system because this will simplify system structure. When part of processes (2) and (4) is performed with the partially common system, different gas/liquid separation towers may be used for separation and recovery of gas components in processes (2) and (4), but the rest of the operation may be conducted with the same system. That is, the liquid components separated by the respective gas/liquid separation towers in processes (2) and (4) are mixed, they are separated into light component and heavy component using the same distillation column, the light component and part of the heavy component are recovered using the same system, and then the remainder heavy component is fed as starting material for above-mentioned process (3).

In the present invention, the temperature that serves as the criterion for separation of heavy component and light component in above-mentioned processes (2) and (4) is called the recycle cut point (RCP). The RCP can be selected in accordance with the middle distillate products that are to be obtained, but it is preferred that the RCP be selected from within a range of 250 to 300° C. when jet fuel distillate or kerosene distillate is the object of distillation and gas oil distillate is not the object of distillation. When gas oil distillate is included as a desired distillate, it is preferred that the RCP be selected from within a range of 330 to 420° C.

Part of the heavy component in above-mentioned processes (2) and (4) will be recovered without becoming second-stage feed oil and removed to outside the system. There is a total of 0 to 30 vol %, preferably 0.1 to 20 vol %, particularly 0.5 to 10 vol %, heavy component recovered per volume feed oil for two-stage hydrocracking (first-stage feed oil). The heavy component recovered here is component recovered by two-stage hydrocracking without being converted to middle distillate products and therefore, recovery of more than the above-mentioned range of heavy component is undesirable because the total conversion percentage, which is discussed later, will decrease and the yield of middle distillate products that are to be obtained will decrease.

The use of the heavy component recovered here can be used as part of the feed oil for the catalytic cracking process or lubricant-production process as a substrate for heavy oil products, but is not restricted thereto. Moreover, it can also be used for part of the first-stage feed oil of two-stage hydrocracking. There are no particular restrictions to the flow of the two-stage hydrocracking process of the present invention as long as the above-mentioned requisites are satisfied, and the process flow shown in the above-mentioned book "Hydrocracking Science and Technology" is an example.

[Hydrocracking Conditions]

With respect to reaction conditions, it is preferred that the reaction temperature be 300 to 500° C., particularly 320 to 460° C. It is preferred that hydrogen partial pressure be 8 to 30 MPa, particularly 10 to 22 MPa. The first-stage LHSV should be 0.1 to 10 $h^{-1}$, particularly 0.3 to 5 $h^{-1}$. It is preferred that the second-stage LHSV be 0.1 to 10 $h^{-1}$, particularly 0.3 to 5 $h^{-1}$. It is preferred that the first-stage hydrogen/oil ratio be 200 to 5,000 NL/L and the second-stage hydrogen/oil ratio be 200 to 5,000 NL/L. It is preferred that the organonitrogen compound concentration of the second-stage feed oil be 0 to 100 ppm by weight, particularly 0 to 10 ppm by weight, in terms of nitrogen. It is preferred that the first-stage conversion percentage be 20 to 60 vol %, the second-stage once-through conversion percentage be 20 to 80 vol %, and the total conversion percentage be 50 to 100 vol %, particularly 80 to 99.5 vol %, further, 90 to 99 vol %.

Incidentally, the first-stage conversion percentage is defined as first-stage conversion percentage={1−(volume quantity of flow of heavy component when first-stage product was separated based on RCP/volume quantity of flow of feed oil fed to first-stage)}×100 [vol %]. The second-stage once-through conversion percentage is defined as second-stage once-through conversion percentage={1−(volume quantity of flow of heavy component when second-stage product was separated based on RCP/volume quantity of flow of feed oil fed to second-stage)}×100 [vol %]. The total conversion percentage is defined as total conversion percentage={1−(volume quantity of flow of heavy component when product of entire two-stage hydrocracking was separated based on RCP/volume quantity of flow of feed oil fed to first-stage)}×100 [vol %].

[Cracking Activity of Catalyst]

The hydrocracking method of the present invention is characterized in that the cracking activity of the first-stage catalyst is higher than the cracking activity of the second-stage catalyst. Specifically, a cracking activity of the catalyst can be evaluated from indices ΔT1 and ΔT2, which are discussed below. Either ΔT1 or ΔT2 must be positive and it is preferred that ΔT1 and ΔT2 both be positive.

[Index ΔT1 Relating to Cracking Activity of Catalyst]

Index ΔT1 is assigned as the index that shows the difference in cracking activity between the second-stage catalyst and the first-stage catalyst under a condition that is similar to the first-stage reaction condition where catalyst poison is also present at high concentrations. Index ΔT1 is defined as $\Delta T1 = T1\ (2^{nd}) - T1\ (1^{st})$ [° C.]. In the formula T1 ($1^{st}$) means the temperature needed to reach the target cracking percentage when hydrocracking is conducted with only the first-stage catalyst under a reaction condition that is essentially the same, except for reaction temperature, as the reaction condition in the first-stage when first-stage feed oil and catalysts used in two-stage hydrocracking are reacted in the presence of hydrogen. In the formula T1 ($2^{nd}$) means the temperature needed to reach the target cracking percentage when hydrocracking is conducted with only the second-stage catalyst under a reaction condition that is essentially the same except for reaction temperature as the reaction condition in the first-stage when first-stage feed oil and catalysts used in two-stage hydrocracking are reacted in the presence of hydrogen. In the above-definitions of T1 ($1^{st}$) and T1 ($2^{nd}$), the phrase "a reaction condition that is essentially the same, except for reaction temperature, as the reaction condition in the first-stage" is intended to include a situation that the LHSV, hydrogen partial pressure and hydrogen/oil ratio are within a range of ±20% of those of the first-stage of two-stage hydrocracking.

The target cracking percentage is within a range of 35 to 60 wt %. Incidentally, the cracking percentage is defined as cracking percentage={1−(wt % of distillate with boiling point of CP1 or higher in product)/(wt % of distillate with boiling point of CP1 or higher in feed oil)}×100 [wt %]. CP1 is the cut point at which the uncracked heavy distillate and cracked lightweight distillate are differentiated from one another and is the same as the RCP or within a range of RCP ±15° C. Incidentally, ΔT1 is unlikely to change markedly when CP1 is within a range of 250 to 400° C. and the target cracking percentage is within a range of 30 to 80 wt %.

Any method can be used to calculate T1 as long as it is a technologically valid method. An example is the method whereby the reaction temperature is varied as needed and the reaction temperature at which the target cracking percentage is reached is experimentally discovered. Moreover, the method whereby the decomposition reaction rate constant at various temperatures is found based on the cracking percentage obtained at multiple reaction temperatures, the corresponding Arrhenius plot is made and the Arrhenius formula for the catalyst in question is derived, and the reaction temperature that gives the reaction rate constant corresponding to the desired cracking rate is calculated is also preferred. However, in this case, it is preferred that at least two, preferably three or more, reaction temperatures be used for the reaction that is conducted in order to calculate Ti. Moreover, it is preferred that T1 be within a range of the minimum reaction temperature and maximum reaction temperature of the reactions used.

It is preferred that a first-stage catalyst and second-stage catalyst be selected and used in two-stage hydrocracking so that ΔT1 that is obtained as described above is 5° C. or higher. It is more preferred that ΔT1 is within a range of 5 to 20° C. for the catalyst regeneration method of the present invention, which is described later. ΔT1 outside this range is undesirable because there will be problems in that life of the first-stage catalyst will be short and there will be a reduction in the middle distillate product yield during the second-stage.

[Index ΔT2 Relating to Catalytic Cracking Activity]

Index ΔT2 is assigned as the index that shows the difference in cracking activity between the second-stage catalyst and first-stage catalyst under a condition similar to the reaction condition of the second-stage wherein catalyst poisons are present in very small concentrations. There are 10 ppm by weight or less of second-stage feed oil or nitrogen content used in two-stage hydrocracking. Index ΔT2 is defined as ΔT2=T2 ($2^{nd}$)−T2($1^{st}$) [° C.]. In the formula, T2($1^{st}$) means the temperature needed to reach the target cracking percentage when hydrocracking is performed with the first-stage catalyst under a condition that is essentially the same, except for reaction temperature, as the second-stage when feed oil with a 10% distillation temperature of 300° C. or higher, 95% distillation temperature of 545° C. or lower and aromatic carbon/total carbon ratio (IP392) of 1 to 15% is reached with catalyst in the presence of hydrogen. In the formula, T2 ($2^{nd}$) means the temperature needed to reach the target cracking percentage when hydrocracking is performed with the second-stage catalyst under a condition that is essentially the same except for reaction temperature as the second-stage when feed oil with a 10% distillation temperature of 300° C. or higher, 95% distillation temperature of 545° C. or lower and aromatic carbon/total carbon ratio (IP392) of 1 to 15% is reached with catalyst in the presence of hydrogen. In the definition of T2 ($1^{st}$) and T2 ($2^{nd}$), the phrase "a condition that is essentially the same except for reaction temperature as the second-stage" is intended to include a situation that the LHSV, hydrogen partial pressure, and hydrogen/oil ratio are each within a range of ±20% of those of the second-stage of two-stage hydrocracking.

The target cracking percentage is within a range of 55 to 75 wt %. Incidentally, the cracking percentage is defined as cracking percentage={1−(wt % of distillate with boiling point of CP2 or higher in product)/(wt % of distillate with boiling point of CP2 or higher in feed oil)}×100 [wt %]. CP2 is the cut point at which the uncracked heavy distillate and cracked lightweight distillate are differentiated from one another and is usually the same as the RCP. Incidentally, ΔT2 does not change markedly when CP2 is within a range of 250 to 400° C. and the target cracking percentage is within a range of 30 to 80 wt %. As with calculation of T1, any method can be used to calculate T2 as long as it is a technologically valid method.

It is preferred that the first-stage catalyst and second-stage catalyst be selected and used in two-stage hydrocracking so that ΔT2 that is obtained as described above is 10° C. or higher. ΔT2 outside this range is undesirable because there will be problems in that life of the first-stage catalyst will be short and there will be a reduction in the middle distillate product yield during the second-stage.

[Catalyst]

There are no particular restrictions to the composition, production method, and form of constituent components of the first-stage and second-stage catalysts used in two-stage hydrocracking of the present invention, but a catalyst where hydrocracking active component is supported on a carrier made of refractory oxide, such as alumina, silica, etc., is one preferred form. It is preferred that this carrier contain composite oxide with solid acidity and zeolite on an alumina matrix, as described later.

[Carrier]

It is preferred that the zeolite content in the carrier be lower with the second-stage catalyst than the first-stage catalyst, or that the amount of ammonia TPD acid of the zeolite contained in the carrier be lower with the second-stage catalyst than the first-stage catalyst when a catalyst with hydrogenation active component supported on the carrier is used as the first-stage catalyst and second-stage catalyst in two-stage hydrogenation of the present invention. Further, it is preferred that the zeolite content of the carrier of the second-stage catalyst be 0.05-times to 0.5-times the zeolite content of the carrier of the first-stage catalyst or that the amount of ammonia TPD acid from zeolite in the carrier of the second-stage catalyst be 0.05-times to 0.5-times the amount of ammonia TPD acid from the zeolite in the carrier of the first-stage catalyst. A zeolite content of the carrier or amount of ammonia TPD acid that does not satisfy the above-mentioned conditions is undesirable because there will be a reduction in middle distillate products yield and cracking activity and stability of the catalyst will be lost.

There are no special restrictions to the zeolite content of the carrier of the first-stage catalyst and second-stage catalyst, but it is preferred that the zeolite content of the carrier of the second-stage catalyst be within a range of 0 to 40 wt %, further 0.1 to 20 wt %, particularly 0.2 to 10 wt %. Moreover, as long as the above-mentioned conditions are satisfied, zeolite with the same properties or zeolites with different properties can be used for the first-stage catalyst and second-stage catalyst when both the first-stage catalyst and second-stage catalyst contain zeolite. Moreover, the first-stage catalyst and second-stage catalyst may each contain one type of zeolite or two or more types of zeolite. There are no particular restrictions to the composition, production method or constituent components of the carrier of the first-stage catalyst or second-stage catalyst, but a carrier comprising dispersion of the composite oxide dispersed in the alumina matrix which will be discussed later and zeolite is one preferred form.

[Zeolite]

Zeolite is the name of crystalline hydrous aluminosilicate represented by the general formula $xM_{2/n}O \cdot Al_2O_3 \cdot ySiO_2 \cdot zH_2O$ (Here, n is the valency of cation M, x is a number of 1 or less, y is a number of 2 or more, and z is a number of 0 or more.). Examples are faujasite-type zeolite (FAU), L-type zeolite (LTL), mordenite-type (MOR), zeolite β (BEA), ZSM-5 (MFI), ferrierite (FER), A-type zeolite (LTA), etc. The zeolite used in the present invention is not restricted to these, but X-type, Y-type, Ω-type, and L-type zeolite are preferred and Y-type zeolite is particularly preferred.

When any of these zeolites is used, the amount of ammonia TPD acid of the zeolite only is preferably under 2.0 mmol/g, particularly under 1.5 mmol/g, further 0.1 to 1.5 mmol/g. An amount of ammonia TPD acid higher than this is undesirable because there will be a reduction in the middle distillate products yield. When Y-type zeolite is used, it is preferred that the unit lattice constant is 24.20 to 24.40 Å. A unit lattice constant higher than this range is undesirable because there will be a reduction in the middle distillate products yield and lower than this range is undesirable because there will be a reduction in cracking activity of the hydrocracking catalyst. When aluminosilicate type-Y zeolite is used, the silica alumina ratio is preferably 6 or higher, further, 15 to 150.

The amount of ammonia TPD acid from zeolite contained in carrier used in the present invention means the number obtained in that the amount of ammonia TPD acid in the zeolite itself is multiplied by the zeolite content in the carrier. The amount of ammonia TPD acid of the zeolite can be determined by the ammonia temperature elevation/ desorption method ($NH_3$-TPD) which determines the amount of ammonia adsorbed with the device under measurement conditions described in "Niwa: Zeolite, 10, 175 (1993)," etc.

[Composite Oxide]

It is preferred that the carrier used for the catalyst of the present invention contain solid oxide. The composite oxide used in this specification is a composite oxide with solid acidity. For instance, many binary composite oxides are known, for example, from those confirmed to reveal acidity by K. Shibata, T. Kiyoura, H. Kitagawa, K. Tanabe, Bull. Chem. Soc. Jpn., 46, 2985 (1973). The composite oxides used in the present invention are preferably silica alumina, silica titania, silica zirconia, silica magnesia, and silica alumina titania as binary composite oxides and silica alumina titania and silica alumina zirconia as ternary composite oxides. It is preferred that the carrier contain 10 to 90 wt %, further 50 to 85 wt %, composite oxide when a carrier comprising a dispersion of composite oxide dispersed in the alumina matrix discussed later and zeolite is used as the carrier of the first-stage catalyst and second-stage catalyst.

[Alumina Matrix]

It is preferred that the carrier used in the catalysts of the present invention contain alumina matrix. The alumina matrix of the present invention is made preferably from one or two or more kinds of those selected from alumina and boria-alumina. The alumina here is an aluminum oxide, hydroxide and/or hydrate oxide and the boria-alumina is aluminum oxide, hydroxide and/or hydrate oxide containing boria (boron oxide). The boria may also be contained as a mixture or as a solid solution or composite compound. The carrier preferably contains 5 to 50 wt %, further 15 to 35 wt %, alumina matrix when a carrier comprising a dispersion of composite oxide dispersed in alumina matrix and zeolite is used as the carrier of the first-stage catalyst or second-stage catalyst.

There are no special restrictions to the starting materials for the alumina matrix, but it is preferred that a powder consisting of aluminum hydroxide and/or hydrate oxide, particularly aluminum hydrate oxide having a boehmite structure, such as pseudo-boehmite, be used because hydrocracking activity and middle distillate products selectivity can be improved. Moreover, a powder formed of aluminum hydroxide and/or hydrate oxide comprising boria, particularly aluminum hydrate oxide having a boehmite structure, such as pseudo-boehmite containing boria and etc., may also be used as the starting material for the alumina matrix.

[Hydrocracking Active Components]

The first-stage catalyst and second-stage catalyst used in two-stage hydrocracking of the present invention preferably contain hydrocracking active component. There are no special restrictions to the hydrocracking active component, but it is preferred that it contain one or two metal components selected from Group 6, Group 9, and Group 10 of the Periodic Table. Molybdenum, tungsten, cobalt, rhodium, iridium, nickel, platinum and palladium are preferable elements selected from Group 6, Group 9, and Group 10, and a non-noble metal hydrogenation active component, such as molybdenum, tungsten, cobalt, nickel, etc., is preferable. The use of a non-noble metal hydrogenation active component is preferable, and especially preferred, for using the catalyst regeneration method of the present invention. One or a mixture of two or more of these metals may be used.

The amount of these hydrogenation active components added preferably such that the total amount of Group 6, Group 9, and Group 10 elements accounting for the catalyst is 0.05 to 35 wt %, particularly 0.1 to 30 wt %. It is preferred that the amount added be brought to 5 to 20 wt % of the catalyst when molybdenum is used as the metal. It is preferred that the amount added be brought to 5 to 30 wt % of the catalyst when tungsten is used as the metal. Molybdenum and tungsten added in an amount less than the above-mentioned range is undesirable because the catalyst may not have sufficient hydrogenation capability needed for hydrocracking. On the other hand, more than the above-mentioned range is undesirable because aggregation of the hydrogenation active component that is added may readily occur.

Further addition of cobalt or nickel when molybdenum or tungsten is used as the metal is preferred even more because hydrogenation capability is improved. It is preferred that the total amount of cobalt or nickel added in this case be 0.5 to 10 wt % of the catalyst. When one or two or more kinds of noble metals, that is, rhodium iridium, platinum and palladium, are used as the hydrogenation active component, the amount added is preferably 0.1 to 5 wt %. Less than this range may not provide sufficient hydrogenation capability and therefore, is undesirable, while exceeding this range is uneconomic and therefore, is undesirable.

[Mesopore Properties]

A hydrocracking catalyst (first-stage catalyst and second-stage catalyst) used in the present invention with mesopore properties within a specific range shows high middle distillate products selectivity and high cracking activity and is preferred for the production of middle distillate products. So-called mesopore properties can be determined by the nitrogen gas adsorption method and the correlation between the pore volume and pore diameter can be calculated by the BJH method, etc. Moreover, median pore diameter used in this present invention means the pore diameter where cumulative pore volume from the large pore diameter side becomes V/2, with pore volume obtained under conditions of relative pressure of 0.9667 by nitrogen gas adsorption being V. The median pore volume of hydrocracking catalysts is preferably within a range of 40 to 100 Å, further, within a range of 45 to 90 Å, particularly within a range of 50 to 85 Å. A median pore diameter less than this range is undesirable because there will be a reduction in middle distillate products selectivity and larger than this range is undesirable because there may be a reduction in cracking activity of the catalyst. Moreover, it is preferred that the volume of pores with a pore diameter within a range of 40 to 100 Å be at least 0.1 mL/g, further within a range of 0.1 to 1.0 mL/g, particularly within a range of 0.15 to 0.6 mL/g.

[Macropore Properties]

A hydrocracking catalyst (first-stage catalyst and second-stage catalyst) used in the present invention with macropore properties within a specific range shows high middle distillate products selectivity and high cracking activity and is preferred for the production of middle distillate products. Macropore properties can be determined using the so-called mercury intrusion porosimetry method and can be calculated assuming that all pores are cylindrical, with the angle of contact with mercury being 140° and surface tension being 480 dynes/cm. It is preferred that the volume of pores having a pore diameter within a range of 0.05 to 0.5 $\mu$m is 0.05 to 0.5 mL/g and the volume of pores with a pore diameter of 0.5 to 10 $\mu$m is less than 0.05 mL/g. Macropores within such a range appear to have the effect of improving diffusion of the reaction molecules and are beneficial in terms of improving middle distillate products selectivity. However, a volume of macropores exceeding this range is not effective because the improvement of middle distillate products selectivity may not substantially increase and on the contrary, there may be a reduction in cracking activity of the catalyst and a reduction in mechanical strength of the catalyst due to a reduction in catalyst packing density.

[Second-Stage Catalyst Containing Nitrogen Content]

In the present invention, an even more preferred method of producing middle distillate products can be provided by two-stage hydrocracking with the second-stage catalyst containing nitrogen content. That is, by intentionally having a nitrogen content present in the second-stage catalyst layer in which ammonia and organonitrogen compounds otherwise should have been present in very low concentrations, two-stage hydrocracking becomes stable and improvement of the middle distillates product yield and inhibition of the rate at which the second-stage catalyst degrades becomes possible. There are no special restrictions to the form of the nitrogen content, but it is preferred that it be in the form of ammonia or organonitrogen compounds. As an example, organonitrogen compounds are amines, aniline, pyridine, quinoline, indole, carbazole and their derivatives. The operation by which nitrogen content is added to the second-stage catalyst can be performed before the catalyst is packed in the reaction vessel or can be performed using pre-treatment agent or additive after the catalyst has been packed in the reaction vessel, as described later. The amount of nitrogen content contained in the second-stage catalyst is preferably at least 0.01 wt %, further, 0.01 to 1 wt %, particularly 0.01 to 0.1 wt %, as nitrogen weight in terms of catalyst weight.

[Pretreatment Agent of Second-Stage Catalyst]

The pre-treatment agent of the second-stage catalyst that is used in the present invention is selected from the group comprising ammonia, organonitrogen compound and petroleum distillate having a 90% distillation temperature lower than the 50% distillation temperature of the second-stage feed oil and containing 10 ppm by weight or more nitrogen content. When petroleum distillate is used as the pre-treatment agent, it is preferred that one whose boiling point is within a range of 150 to 420° C. be used. It is particularly preferred that the petroleum distillate contains one or two or more kinds of amines, aniline, pyridine, quinoline, indole, carbazole, and their derivatives.

[Method of Pre-treatment of Second-Stage Catalyst]

It is preferred that the second-stage catalyst of the present invention be pre-treated with the above-mentioned pre-treatment agent prior to being used under hydrocracking conditions. When the second-stage catalyst is to be used under hydrocracking conditions after preliminary sulfurization treatment, this pretreatment can be performed before or after preliminary sulfurization treatment. However, it is preferred that it be performed simultaneously with preliminary sulfurization treatment because the time needed for pre-treatment and preliminary sulfurization treatment can be curtailed. In this case, preliminary sulfurization treatment may be gas-phase sulfurization or liquid-phase sulfurization and any one of the pre-treatment agent may be used so long as the above-mentioned requirement is satisfied. It is particularly preferred that sulfur compound, such as carbon disulfide, dimethyl sulfide, dimethyl disulfide, etc., is added to petroleum distillate preferably used as pre-treatment agent is brought into contact with catalyst.

[Two-Stage Hydrocracking by Addition of Additives to Second-Stage]

According to the present invention, it is preferred that the reaction be performed while adding additive to the second-stage of two-stage hydrocracking because it has the effect of inhibiting the rate of degradation of the second-stage catalyst while improving the middle distillate products yield. This additive may be selected as needed as long as the additive causes the above-mentioned effect, but it is preferably selected from the group consisting of ammonia, organonitrogen compound, and petroleum distillate having a 90% distillation temperature lower than the 50% distillation temperature of the feed oil and containing 10 ppm by weight or more nitrogen content. When petroleum distillate is used as the additive, one with a boiling point within a range of 150 to 420° C. is preferred, and in particular, the petroleum distillate preferably contain one or two or more kinds of amines, aniline, pyridine, quinoline, indole, carbazole, and their derivatives. The amount added is preferably such that the nitrogen content derived from the additives is 0.01 to 5 ppm in the feed oil fed to the second-stage (second-stage feed oil). Addition to a concentration higher than this range is undesirable because the effect of inhibiting cracking activity of the second-stage catalyst as a result of poisoning by the nitrogen compound may be marked. Addition to a concentration lower than this range is undesirable because the effects of adding the additive are not obvious. There are no special restrictions to the method of feeding the additive, but it is particularly preferred to add it to the heavy component that will be recycled to the second-stage catalyst to feed it to the second-stage catalyst.

[Method of Regeneration of Hydrocracking Catalyst]

The method of regeneration of the first-stage catalyst of the present invention involves simultaneously performing the process of catalyst regeneration, in which the first-stage catalyst supporting non-noble metal hydrogenation active component is brought to an oxygen atmosphere under heating conditions and then brought into contact with sulfur compound, and the process in which the first-stage feed oil is brought into contact with the second-stage catalyst in the presence of hydrogen to obtain the product. The method of regeneration of the second-stage catalyst involves simultaneously performing the catalyst regeneration process, in which the second-stage catalyst supporting non-noble metal hydrogenation active component is brought to an oxygen atmosphere under heating conditions and then brought into contact with sulfur compound, and the process in which the first-stage feed oil is brought into contact with the first-stage catalyst in the presence of hydrogen to obtain the product. It is preferred that regeneration of the second-stage catalyst is performed after regeneration of the first-stage catalyst has been performed. The preferred heading condition for regeneration under an oxygen atmosphere is 300 to 500° C., particularly 330 to 470° C. An ambient atmosphere containing 0.1 to 20 vol %, particularly 0.2 to 5 vol % oxygen is preferred as the oxygen atmosphere. The heating condition for regeneration whereby contact is made with a sulfur compound is preferably 120 to 400° C., and it is preferred that the sulfur compound be brought into contact with the catalyst in the presence of oxygen. Carbon disulfide, dimethyl sulfide, dimethyl disulfide, etc., are preferably used as the sulfur compound for regeneration. A sulfur compound with at least 80%, particularly 100% or more, of the stoichiometric amount of sulfur ions necessary for sulfurization of the total amount of hydrogenation active compound is preferably brought into contact for regeneration of the catalyst that will be brought into contact with sulfur compound.

By means of this regeneration method, hydrocracking can continue using part of the process without full-scale shutdown of the hydrocracking process. This is possible because the catalyst used during the second-stage of the two-stage hydrocracking operation, when catalyst poisons are present in very low concentrations, functions to the fullest as a hydrocracking catalyst, even under conditions where catalyst poison are also present in high concentrations. First, for instance, the first-stage catalyst is regenerated while hydrocracking is being performed using the second-stage only. Then the second-stage catalyst is regenerated while hydrocracking is being performed using the first-stage only. Then it is possible for the operation to proceed two-stage hydrocracking with the regenerated catalyst. As a result, there is a marked reduction in the time that is otherwise wasted when the hydrocracking process is stopped for catalyst regeneration and this has an exceptional effect in terms of making refinery operation more economic.

EXAMPLES

The present invention will now be described in detail with examples, but the present invention is not limited to these examples.

[Preparation of Catalyst A]

Zeolite powder, silica alumina powder, and pseudo-boehmite powder were mixed and kneaded and molded into a cylinder shape. It was dried and baked at 600° C. to prepare the carrier. In terms of dry carrier, this carrier consisted of 3.5 wt % zeolite, 76.5 wt % silica alumina, and 20 wt % alumina and was a cylinder shape with a diameter of approximately 1.6 mm. Aluminosilicate Y-type zeolite having a silica alumina molar ratio of 30.3, unit lattice constant of 24.31 Å, and amount of ammonia TPD acid of 0.46 mmol/g was used as the zeolite powder. Silica alumina powder with a silica/alumina molar ratio of 4.4 was used. This carrier was impregnated in succession with an aqueous solution containing ammonium metatungstate and an aqueous solution containing nickel nitrate and then dried and baked to prepare catalyst A containing 22 wt % tungsten and 2 wt % nickel in the catalyst.

When the pore properties of catalyst A were determined by the nitrogen adsorption method, median pore diameter was 52 Å and the volume of ones with a pore diameter within a range of 40 to 100 Å was 0.20 mL/g. When pore properties of catalyst A were determined by the mercury intrusion porosimetry method, the volume of pores with a pore diameter within a range of 0.05 to 0.5 $\mu$m was 0.071 mL/g and the volume of pores with a pore diameter of 0.5 to 10 $\mu$m was 0.002 mL/g.

[Preparation of Catalyst B]

Except that starting powder was mixed so that the carrier contains 1.0 wt % zeolite, 79 wt % silica alumina and 20 wt % alumina in terms of dry carrier, carrier B was prepared in the same way as above-mentioned carrier A. The same zeolite as used for catalyst A was employed. Consequently, the carrier of catalyst B had approximately 0.29-times the amount of ammonia TPD acid derived from zeolite as the carrier of catalyst A. When pore properties of catalyst B were determined by the nitrogen adsorption method, the median pore diameter was 53 Å and the volume of pores with a pore diameter within a range of 40 to 100 Å was 0.20 mL/g. When the pore properties of catalyst B were determined by the mercury intrusion porosimetry method, the volume of pores with a pore diameter within a range of 0.05 to 0.5 $\mu$m was 0.090 mL/g and the volume of pores with a pore diameter of 0.5 to 10 $\mu$m was 0.004 mL/g.

[Evaluation of Cracking Activity Index T1]

Catalyst A and catalyst B were each packed into a fixed bed flow-through reaction vessel and the reaction was performed under the reaction conditions in Table 2 using Feed A in Table 1 as the feed oil. The aromatic carbon/total carbon ratio was determined in accordance with British Petrochemical Society IP 392, the carbon distribution and cyclic structure were analyzed by the n-d-M method in accordance with ASTM D 3238, and the distillation properties in accordance with ASTM D 1160.

TABLE 1

| | Feed A | Feed B |
|---|---|---|
| Density(15° C.), g/cm$^3$ | 0.9060 | 0.8311 |
| Sulfur content, wt % | 0.46 | <0.001 |
| Nitrogen content, wt ppm | 811 | <1 |
| Vanadium content, wt ppm | <0.6 | <0.6 |
| Nickel content, wt ppm | <0.1 | <0.1 |
| Hydrogen/carbon molar ratio | 1.73 | 2.02 |
| Aromatic carbon/total carbon ratio (IP 392), % | 17 | 3 |
| n-d-M analysis (ASTM D 3238) | | |
| Molecular weight M | 417 | 373 |
| Aromatic carbon $C_A$, % | 16.4 | 2.2 |
| Naphthene carbon $C_N$, % | 23.5 | 13.1 |
| Paraffin carbon $C_P$, % | 60.1 | 84.7 |
| Mean number of aromatic rings $R_A$ | 0.85 | 0.10 |
| Mean number of naphthene rings $R_N$ | 1.37 | 0.69 |
| Distillation properties (ASTM D 1160), ° C. | | |
| IBP | 305.5 | 337.0 |
| 5% | 347.5 | 377.0 |
| 10% | 367.5 | 391.5 |
| 30% | 410.5 | 425.5 |
| 50% | 440.5 | 449.5 |
| 70% | 470.0 | 475.0 |
| 90% | 507.5 | 511.0 |
| 95% | 521.5 | 527.0 |
| EP | 541.0 | 538.5 |

TABLE 2

| | Evaluation of index T1 | Evaluation of index T2 |
|---|---|---|
| LHSV, h$^{-1}$ | 1.36 | 1.36 |
| Hydrogen partial pressure, MPa | 14.7 | 14.7 |
| Hydrogen/oil ratio, NL/L | 1000 | 800 |
| Reaction temperature, ° C. | 420 | 370 |
| | 410 | 360 |
| | 400 | 350 |
| | | 340 |

When T1 at which the cracked percentage of distillate with a boiling point of 293° C. or higher became 40 wt % was calculated, it was 406.9° C. with catalyst A and 415.6° C. with catalyst B and when catalyst A served as the first-stage catalyst for two-stage hydrocracking and catalyst B served as the second-stage catalyst for two-stage hydrocracking, ΔT1 was 8.7° C. Moreover, when T1 at which the cracked percentage of distillate with a boiling point of 360° C. or higher became 55 wt % was calculated, it was 409.1° C. with catalyst A and 418.2° C. with catalyst B, and when catalyst A served as the first-stage catalyst of two-stage hydrocracking and catalyst B served as the second-stage catalyst of two-stage hydrocracking, ΔT1 was 9.1° C.

[Evaluation of Hydrocracking Index T2]

Catalyst A and catalyst B were each packed into a fixed bed flow-through reaction vessel and the reaction was performed under the reaction conditions in Table 2 using Feed B in Table 1 as the feed oil. The cracking rate constant (apparent reaction order: second order) at each temperature was found from the reaction results, the Arrhenius formula was derived, and the T2 of each catalyst was calculated, it was 340.1° C. with catalyst A and 368.9° C. with catalyst B. When catalyst A served as the first-stage catalyst for two-stage hydrocracking and catalyst B served as the second-stage catalyst for two-stage hydrocracking, ΔT2 was 28.8° C. Moreover, when T2 at which the cracked percentage of distillate with a boiling point of 360° C. or higher reached 72 wt % was calculated, it was 340.8° C. with catalyst A and 369.0° C. with catalyst B and when catalyst A served as the first-stage catalyst of two-stage hydrocracking and catalyst B served as the second-stage catalyst of two-stage hydrocracking, ΔT2 was 28.2° C.

[Production of Jet Fuel Distillate by Two-Stage Hydrocracking]

Jet fuel distillate was produced using the two-stage hydrocracking apparatus as shown, for example, in FIG. 1. The feed oil was introduced with hydrogen to first-stage reaction vessel 11 and the product was separated into gas component, such as hydrogen, etc., and liquid component in first-stage high-pressure separation tower 13. This liquid component was introduced to stripper 15 and part of the light component was removed and introduced to vacuum distillation column 16. This was separated into lightweight distillate containing jet fuel distillate and heavy component at vacuum distillation column 16. The heavy distillate that had been separated was mixed with hydrogen and introduced to second-stage reaction vessel 12. This product was separated into gas component, such as hydrogen, etc., and liquid component in second-stage high-pressure separation tower 14. This liquid part was introduced with the liquid part from the tower 13 (the first-stage) to stripper 15. A heater (not shown) for setting the reaction temperature was attached to first-stage reaction vessel 11 and second-stage reaction vessel 12, respectively.

Catalyst A (100 mL) was packed in first-stage reaction vessel 11 of the two-stage hydrocracking apparatus in FIG. 1 and catalyst B (100 mL) was packed into second-stage reaction vessel 12 and pre-treatment agent of 1 vol % hydrogen disulfide dissolved in gas oil with a boiling point range of 250 to 360° C. containing 400 ppm by weight sulfur content and 50 ppm by weight nitrogen content was brought into contact with each catalyst in the presence of hydrogen for pre-treatment. By means of this pre-treatment, it was possible to simultaneously perform sulfurization treatment of the catalyst and treatment to give the second-stage catalyst nitrogen content. The gas oil used here contained 17 ppm by weight acidic nitrogen compound, such as indole and carbazole derivatives, etc., as the nitrogen content and 16 ppm by weight basic nitrogen compound, such as amines and aniline, pyridine, quinoline, etc., derivatives as the nitrogen content.

First, after pre-treatment, operation of the first-stage only was started. The first-stage was operated under operating conditions for the first-stage only in Table 3 by passing feed A in Table 1 through the first-stage as feed oil. Cracking activity of the first-stage catalyst was stabilized and the reaction temperature of the first-stage was brought to 412° C. The product of first-stage reactor 11 was passed through the separation system including first-stage high-pressure separation tower 13 and separated into heavy component and light component, with the cut point (RCP) of vacuum distillation column 16 being 288° C. The conversion percentage in terms of feed oil was 37.0 vol % approximately 450 hours from the time feed oil was first passed. Moreover, when the nitrogen content of the 288° C.+distillate (distillate heavier than 288° C.) at this time was analyzed, it was 4 ppm by weight.

Feeding of heavy component obtained through vacuum distillation column 16 was started 574 hours after feed oil was first passed to the first-stage and two-stage hydrocracking was performed under the operating conditions for jet fuel distillate mode 1 in Table 3. The reaction results approximately 1,531 hours after starting to pass feed oil to the first-stage were as shown in Table 4. The average catalyst degradation rate (the elevation rate of the reaction temperature needed to maintain the first-stage conversion percentage at approximately 38 vol %, the second-stage conversion percentage at approximately 60 vol %, and the total conversion percentage at approximately 95 vol %) approximately 460 hours from the time when approximately 1,875 hours had passed since starting to pass feed oil to the first-stage was 0.057° C./day with the first-stage and 0.19° C./day with the second-stage.

TABLE 3

| | Operation of first-stage only | Jet fuel distillate mode | Jet fuel distillate mode | Middle distillate products mode |
|---|---|---|---|---|
| LHSV(first-stage), $h^{-1}$ | 1.51 | 1.51 | 1.51 | 1.51 |
| LHSV (second-stage), $h^{-1}$ | — | 1.43 | 1.43 | 1.43 |
| Hydrogen partial pressure (first-stage), MPa | 14.7 | 14.7 | 14.7 | 14.7 |
| Hydrogen partial pressure (second-stage), MPa | — | 15.0 | 15.0 | 15.0 |
| Hydrogen/oil ratio (first-stage), NL/L | 1000 | 1000 | 1000 | 1000 |
| Hydrogen/oil ratio (second-stage), NL/L | — | 800 | 800 | 800 |
| RCP, ° C. | 288 | 288 | 288 | 371 |
| Amount of t-butylamine added to second-stage, wt ppm-N/feed | — | 0 | 0.34 | 0.34 |

TABLE 4

| | Jet fuel distillate mode 1 | Jet fuel distillate mode 2 | Middle distillate products mode |
|---|---|---|---|
| Reaction temperature (first-stage) | 415.0° C | 419.0° C. | 419.5° C. |
| Reaction temperature (second-stage) | 372.0° C. | 379.5° C. | 368.5° C. |
| Total conversion percentage | 94.8 vol % | 96.1 vol % | 94.2 vol % |
| First-stage conversion percentage | 37.3 vol % | 37.5 vol % | 54.9 vol % |

TABLE 4-continued

| | Jet fuel distillate mode 1 | | Jet fuel distillate mode 2 | | Middle distillate products mode | |
|---|---|---|---|---|---|---|
| Second-stage once-through conversion percentage | 60.7 vol % | | 61.0 vol % | | 41.7 vol % | |
| Amount of hydrogen consumed (in terms of feed oil) | 2.3 wt % | | 2.7 wt % | | 2.1 wt % | |
| Product yield (in terms of feed oil) | by weight (%) | by volume (%) | by weight (%) | by volume (%) | by weight (%) | by volume (%) |
| Hydrogen sulfide | 0.5 | | 0.5 | | 0.5 | |
| Ammonia | 0.1 | | 0.1 | | 0.1 | |
| C1–C4 | 6.4 | | 6.0 | | 4.8 | |
| C5–82° C. | 11.1 | 15.1 | 10.9 | 14.8 | 8.0 | 10.9 |
| 82–127° C. | 15.3 | 18.8 | 14.4 | 17.8 | — | — |
| 127–288° C. | 64.1 | 73.3 | 67.0 | 76.8 | — | — |
| 288°C.+ | 4.8 | 5.2 | 3.7 | 3.9 | — | — |
| 82–166° C. | — | — | — | — | 17.4 | 21.0 |
| 166–371° C. | — | — | — | — | 65.9 | 72.8 |
| 371° C.+ | — | — | — | — | 5.5 | 5.8 |

[Production of Jet Fuel Distillate by Two-Stage Hydrocracking Wherein Additives are Added to Second-Stage]

Two-stage hydrocracking was performed continuous with operation of the above-mentioned jet fuel distillate mode 1 under operating conditions for jet fuel distillate mode 2 in Table 3 with feed A in Table 1 as the feed oil. Moreover, the reaction was performed by feeding t-butylamine to second-stage reaction vessel 12 so that the nitrogen content of the second-stage feed (second-stage feed oil) is approximately 0.34 ppm using t-butylamine as the additive.

The average catalyst degradation rate (the elevation rate of the reaction temperature needed to maintain the first-stage conversion percentage at approximately 38 vol %, the second-stage conversion percentage at approximately 60 vol %, and the total conversion percentage at approximately 95 vol %) approximately 1,700 hours from the time when a total of approximately 2,493 hours had passed since starting to pass feed oil to the first-stage was 0.042° C./day with the first-stage and 0.058° C./day with the second-stage. The reaction results when feed oil had been passed to the first-stage for a total of approximately 3,800 hours were as shown in Table 4.

The 127 to 288° C. distillate obtained by distillation of the product obtained at this time with the Automated TBP Distillation Device Model PME-3010SR made by Toka Seiki Co., Ltd. had distillation properties (ASTM D 86) of a 10% distillation temperature of 168.0° C. and end point of 273.5° C. The property of the distillate obtained is as follows: the density (15° C.) was 0.7912 g/cm$^3$, the aromatic carbon/total carbon ratio (IP 392) was 4% and the smoke point was 31 mm. It was concluded from the above-mentioned that a higher quality jet distillate is obtained at a higher yield. Moreover, it was concluded that the jet distillate yield is improved and the second-stage catalyst degradation rate is markedly reduced by operating with additive added to the second-stage.

[Production of Middle Distillate by Two-Stage Hydrocracking]

Two-stage hydrocracking was performed continuous with operation of the above-mentioned jet fuel distillate mode 2 by changing the operating conditions to the middle distillate mode in Table 3 using Feed A in Table 1 as the feed oil. However, the reaction was performed by feeding t-butylamine to second-stage reaction vessel 12 so that the nitrogen content of the second-stage feed (second-stage feed oil) is approximately 0.34 ppm using t-butylamine as the additive. The reaction results in jet fuel distillate mode 2 when the feed oil had been passed for a total of approximately 4,640 hours since starting to pass feed oil to the first-stage were as shown in Table 4.

The 166 to 371° C. distillate obtained by distillation of the product obtained at this time with the Automated TBP Distillation Device Model PME-3010SR made by Toka Seiki Co., Ltd. had distillation properties (ASTM D 86) of a 5% distillation temperature of 194.0° C., a 10% distillation temperature of 199.0° C., a 50% distillation temperature of 262.0° C., a 90% distillation temperature of 336.0° C., a 95% distillation temperature of 345.0° C., and end point of 351.5° C. The property of the distillate obtained is as follows: the density (15° C.) was 0.8200 g/cm$^3$, the sulfur content was less than 1 ppm by weight, the cetane index (ASTM D 4737) was 56.8, and the aromatic carbon/total carbon ratio (IP 392) was 5%. It was concluded from the above-mentioned result that a higher quality middle distillate comprising diesel fuel gas oil distillate is obtained at a higher yield.

[Method of Determining Pore Properties]

Gauge model ASAP 2400 made by Micromeritics was used to determine pore properties by the nitrogen adsorption method. The correlation between pore diameter and pore volume was calculated by the BJH method. Moreover, median pore diameter was calculated as the pore diameter with which the cumulative pore volume from the large pore diameter side becomes V/2 when pore volume obtained under conditions of a relative pressure of 0.9667 by the nitrogen adsorption method serves as V. Autopore model 9200 made by Micromeritics Co., Ltd., was used for determination of pore properties by the mercury intrusion porosimetry method. Pore properties were calculated by the mercury intrusion porosimetry method assuming that all pores were cylindrical, with the angle of contact of mercury being 140° and surface tension being 480 dynes/cm.

[Method of Determining Amount of Ammonia TPD Acid of Zeolite]

After heat treatment for 1 hour at 600° C. using a muffle furnace, approximately 50 mg zeolite sample that had been cooled to room temperature in a desiccator were weighed out, introduced to a determination cell, and placed on a device for determining the amount of ammonia TPD acid (TPD-1-AT made by Nihon Beru Co., Ltd.). Temperature was raised to 500° C. at 10° C./minute under reduced pressure of $1.3\times10^{-5}$ Torr and the sample was treated for 30 minutes under reduced pressure at 500° C. Then it was cooled down to 100° C. under reduced pressure. Ammonia gas was introduced to the cell at a pressure of 100 Torr and left it for 30 min at 100° C. After that, helium gas was introduced to the cell and passed through for 1 hour at a flow rate of 50 mL/minute. After performing the above-mentioned pre-treatment, the desorbed ammonia was quantitatively determined by monitoring mass number 16 at a determination pressure of $9\times10^{-6}$ Torr using a mass analyzer (quadripole mass analyzer AQA-100R made by Nichiden Aneruba Co., Ltd.) while raising the sample temperature at 10° C./minute. After raising temperature to 600° C., it was kept at 600° C. for another 20 minutes while continuing to quantitatively determine the desorbed ammonia. The total number of moles of ammonia that had been desorbed in 70 minutes was found by the above-mentioned method and divided by the amount of zeolite sample to calculate the amount of ammonia TPD acid of the zeolite.

If activity of the catalyst of one of the reaction vessels had dropped to a specific level while catalytic activity was being monitored during operation of the first-stage reaction vessel and second-stage reaction vessel in the above-mentioned example, it is possible to stop operation of that reaction vessel and regenerate the catalyst by heating in an oxygen atmosphere and introducing sulfur compound. In this case, the other reaction vessel could continue to operate as is. Moreover, once regeneration of one reaction vessel is completed, operation of the two reaction vessels can be re-started. It is also possible to stop the other reaction vessel while re-starting operation of the one reaction vessel that has been regenerated and regenerate the other catalyst by heating in an oxygen atmosphere and introducing sulfur compound.

By means of the method of the present invention, it is possible to produce middle distillate products by two-stage hydrocracking that has high cracking activity, stability, and middle distillate products selectivity. Moreover, it is possible to convert starting materials of a lower quality and obtain high-quality middle distillates that meet environmental regulations and have excellent properties as fuel.

It is possible to present a two-stage hydrocracking method for producing middle distillate products, with which the conversion percentage is high and the same cracking reaction of the entire two-stage hydrocracking process proceeds with long-term stability at high selectivity for middle distillate products, and a catalyst for the method thereof. Moreover, it is possible to present a method of producing middle distillate products whereby materials of a lower quality are converted to obtain high-quality middle distillate products that meet environmental regulations and have excellent properties as petroleum products, such as fuel oil, etc. Furthermore, it is possible to provide a catalyst regeneration method with which little time is wasted for catalyst regeneration during hydrocracking and operation flexibility is high.

What is claimed is:

1. A method of producing middle distillate products by two-stage hydrocracking comprising the steps of:

bringing a first-stage feed oil containing a hydrocarbon component with a boiling point of 316° C. or higher into contact with a first-stage catalyst in the presence of hydrogen with a partial pressure of 8 to 30 MPa to obtain a first-stage product;

separating the first-stage product into a first heavy component and a first light component containing the middle distillate products;

bringing a second-stage feed oil containing the first heavy component into contact with a second-stage catalyst in the presence of hydrogen with a partial pressure of 8 to 30 MPa to obtain a second-stage product; and separating the second-stage product into a second heavy component and a second light component containing the middle distillate products and bringing part of the second heavy component into contact with the second-stage catalyst again;

wherein a hydrocracking activity of the first-stage catalyst is greater than a hydrocracking activity of the second-stage catalyst.

2. The method of producing the middle distillate products by two-stage hydrocracking according to claim 1, wherein the first-stage catalyst and second-stage catalyst are catalysts formed by supporting hydrogenation active component of at least one component selected from the group consisting of Group 6, Group 9 and Group 10 of the Periodic Table on a carrier made of refractory oxide containing zeolite.

3. The method of producing the middle distillate products by two-stage hydrocracking according to claim 1, wherein the first-stage catalyst is a catalyst formed by supporting a hydrogenation active component on a carrier containing zeolite and the second-stage catalyst is a catalyst formed by supporting a hydrogenation active component on a carrier containing zeolite whose content is less than that of the first-stage catalyst.

4. The method of producing the middle distillate products by two-stage hydrocracking according to claim 1, wherein the first-stage catalyst is a catalyst having a hydrogenation active component supported on a carrier containing zeolite, and the second-stage catalyst is a catalyst formed by supporting a hydrogenation active component on a carrier containing zeolite whose amount of ammonia TPD is less than the amount of ammonia TPD acid of the zeolite contained in the carrier of the first-stage catalyst.

5. The method of producing the middle distillate products by two-stage hydrocracking according to claim 1, wherein the second-stage catalyst contains at least 0.01% nitrogen component by weight.

6. The method of producing the middle distillate products by two-stage hydrocracking according to claim 1, further comprising a step of adding ammonia or an organic nitrogen compound to the second-stage catalyst before or while bringing the second stage feed oil with the second-stage catalyst.

7. A method of producing middle distillate products by two-stage hydrocracking using a first-stage catalyst and a second-stage catalyst layers, each of which has a catalyst is formed by supporting hydrogenation active component of at least one component selected from the group consisting of Group 6, Group 9 and Group 10 of the Periodic Table on a carrier, comprising:

a first step of regenerating a catalyst in one of the first-stage and second-stage catalyst layers by heating and exposing to an oxygen atmosphere the catalyst and by bringing the catalyst in the one of catalyst layers into contact with a sulfur compound; and a second step of bringing feed oil into contact with the catalyst in the other of the first-stage and second stage catalyst layers in the presence of hydrogen during the first step in order to obtain a product.

8. The method of producing the middle distillate products by two-stage hydrocracking according to claim 7, further comprising:

a third step of regenerating the catalyst in the other catalyst layer by heating and exposing to an oxygen atmosphere the catalyst in the other catalyst layer, and bringing the catalyst in the other catalyst layer into contact with a sulfur compound, after the regeneration of the catalyst in the first step has been completed and the second step has been interrupted;

and a fourth step of bringing feed oil into contact with the catalyst in the one of catalyst layers of said first step in the presence of hydrogen to obtain a product.

9. The method of producing the middle distillate products by two-stage hydrocracking according to claim 7, wherein once regeneration of a catalyst in the first step has been completed, a step of bringing feed oil into contact with the catalyst in the one of catalyst layers of said first step is restarted to obtain a product.

10. The method of producing the middle distillate products by two-stage hydrocracking according to claim 9, further comprising the steps of:

separating the product from the first-stage catalyst layer into a first heavy component and a second light component containing the middle distillate products;

feeding a second-stage feed oil containing the first heavy component to the second-stage catalyst layer to obtain a second-stage product; and separating the second-stage product into a second heavy component and a second light component containing the middle distillate products and bringing part of the second heavy component into contact with the second-stage catalyst once again.

11. The method of producing the middle distillate products by two-stage hydrocracking according to claim 10, wherein the feed oil contains a hydrocarbon component having a boiling point of 316° C. or higher.

12. The production method according to claim 10, wherein hydrocracking activity of the catalyst in the first-stage catalyst layer is higher than hydrocracking activity of the catalyst in the second-stage catalyst layer.

13. The method of producing middle distillate products by two-stage hydrocracking according to claim 1, wherein the hydrogen partial pressure is 10 to 30 Mpa.

* * * * *